US009687894B2

(12) United States Patent
Poloni et al.

(10) Patent No.: US 9,687,894 B2
(45) Date of Patent: Jun. 27, 2017

(54) DESCALING DEVICE FOR THE INTERIOR OF TUBES AND DESCALING PROCESS

(71) Applicant: Danieli & C. Officine Meccaniche S.P.A., Buttrio (IT)

(72) Inventors: Alfredo Poloni, Fogliano Redipuglia (IT); Giuseppe Bordignon, Bicinicco (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 14/900,794

(22) PCT Filed: Jun. 27, 2014

(86) PCT No.: PCT/IB2014/062661
§ 371 (c)(1),
(2) Date: Dec. 22, 2015

(87) PCT Pub. No.: WO2014/207714
PCT Pub. Date: Dec. 31, 2014

(65) Prior Publication Data

US 2016/0136704 A1 May 19, 2016

(30) Foreign Application Priority Data

Jun. 28, 2013 (IT) ..... MI2013A001090

(51) Int. Cl.

| | |
|---|---|
| ***B08B 9/04*** | (2006.01) |
| ***B21B 45/08*** | (2006.01) |
| ***B21C 43/00*** | (2006.01) |
| ***B08B 9/032*** | (2006.01) |
| *B21B 23/00* | (2006.01) |
| *B21B 39/00* | (2006.01) |
| *B21B 45/04* | (2006.01) |

(52) U.S. Cl.
CPC ..... *B21B 45/08* (2013.01); *B08B 9/0321* (2013.01); *B21C 43/00* (2013.01); *B21B 23/00* (2013.01); *B21B 39/00* (2013.01); *B21B 45/04* (2013.01)

(58) Field of Classification Search
CPC ..... B08B 9/0321; B21C 43/00; B21B 45/08; B21B 39/00; B21B 45/04; B21B 23/00
USPC ..... 134/8, 166 R; 15/3.5
See application file for complete search history.

(56) References Cited

U.S. PATENT DOCUMENTS 3,581,384 A 6/1971 Petersen et al.

FOREIGN PATENT DOCUMENTS

| | | |
|---|---|---|
| DE | 1788015 | 5/1959 |
| DE | 4015306 | 6/1991 |
| JP | S56151106 | 11/1981 |
| JP | S58168404 | 10/1983 |
| JP | H06262254 | 9/1994 |

*Primary Examiner* — Eric Golightly
(74) *Attorney, Agent, or Firm* — Stetina Brunda Garred & Brucker

(57) ABSTRACT

The descaling device (100) of the interior of a tube (1) comprises a supporting structure (9), a conveyor (2) for conveying the tube (1) with an inclinable stretch to arrange the tube in an inclined position by an angle with respect to the horizontal plane, a lance (3) with nozzles (4) to spray a fluid inside the tube (1) to carry out the operation of descaling the inner surface. The lance (3) is fixed to guides (7) above the conveyor (2) in an inclined position with respect to the horizontal plane, and may axially slide within the tube (1) during the descaling operation by spraying water into the tube.

8 Claims, 4 Drawing Sheets

DESCALING DEVICE FOR THE INTERIOR OF TUBES AND DESCALING PROCESS

CROSS REFERENCE TO RELATED APPLICATIONS

The present application claims priority to PCT International Application No. PCT/IB2014/062661 filed on Jun. 27, 2014, which application claims priority to Italian Patent Application No. MI2013A001090 filed Jun. 28, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a device for descaling the inner area of tubes and to a descaling method which uses such a device.

BACKGROUND OF THE INVENTION

Devices and processes aimed at removing scale from the inner surface of tubes are known from the prior art. This operation can be carried out downstream of the casting station, downstream of the rolling train or downstream of a heating furnace. Descaling processes often include the use of pressurized water from the nozzles of a lance which runs along the tube.

Some examples of tube descaling processes are known from various documents. U.S. Pat. No. 3,581,384 includes descaling the interior of a continuously cast tube by means of steam or by means of jets of pressurized water.

JP56151106 discloses a descaling process of the interior of the rolled tube by means of a high-pressure nozzle connected to a movable carriage by a rod.

JP58168404 discloses a process which also includes injecting a fine solid lubricant powder and revolving the tube about its longitudinal axis.

JP1626323 discloses a descaling process which includes descaling the interior of the tube obtained with a boring machine by injecting inert gas in a direction opposite to the outlet direction.

All these methods of known type include injecting water into the tube arranged horizontally for the removal of the scale.

Once the pressurized water from the nozzle has struck the inner wall of the tube, it remains at the bottom of the tube itself together with the scale, and this results in the disadvantage of creating an inevitable heat exchange, an excessive cooling of the tube surface and the need to heat it for the next processing operations.

It is thus felt the need to provide a device for descaling the interior of the tubes which allows to overcome the aforesaid drawbacks.

SUMMARY OF THE INVENTION

It is the main object of the present invention to provide a method for descaling the inner surface of the tube which avoids an excessive cooling of the tube.

It is another object of the present invention to provide a device for descaling the inner surface of a tube which requires a limited longitudinal space, thus avoiding the tube production line from being excessively extended.

It is a further object of the present invention to provide a method for descaling the inner surface of the tube which allows to keep the tube to be processed in line, thus avoiding lateral displacements and off-line stations.

It is a further object of the present invention to provide a method for descaling the inner surface of the tube which also facilitates the depositing of an antioxidant fluid on the surface itself.

These and other objectives which will become more apparent from the reading of the following description are achieved by means of a descaling device for descaling an inner surface of a tube comprising a supporting structure, a conveyor for conveying, the tube in a direction parallel to a longitudinal axis of the tube, a conveyor portion which is inclinable to be arranged in a first, predetermined inclined position with respect to a horizontal plane, a lance for spraying a fluid inside the tube to perform an operation of descaling the inner surface, fixed to tiding guiding means above the conveyor in the predetermined inclined position, means for actuating the lance in order to translate the lance in the axial direction inside the tube during the descaling operation.

According to another aspect of the invention, the aforesaid objectives are achieved by a descaling process implemented by means of the above-described device and comprising the following steps:

a) conveying the tube, by means of the conveyor, to the descaling device and inclining it with respect to the horizontal plane by a predetermined angle, b) revolving the tube about its longitudinal axis, c) introducing the lance into the tube and actuating the high-pressure water jets on the inner surface of the tube, d) extracting the lance from the interior of the tube during a return stroke, e) positioning the tube on the horizontal axis by lowering the inclinable conveyor portion.

The advantage of the method of the invention is apparent, since it avoids an excessive cooling of the material of the tube by providing the immediate outflow of the descaling water and of the related scale.

Furthermore, the arrangement of the lance which supplies the pressurized water into the tube does not contribute to extending the tube production line because it is kept above the tube conveying line when the descaling operation is not performed, in a space which is not used in the other known tube production systems.

The dependent claims describe preferred embodiments of the invention.

BRIEF DESCRIPTION OF THE DRAWINGS

Further features and advantages of the invention will become more apparent in the light of the detailed description of preferred, but not exclusive, embodiments of a descaling device shown by way of non-limitative example, with the aid of the accompanying drawings, in which.

The same reference numerals in the figures identify the same elements or components.

DETAILED DESCRIPTION OF PREFERRED EMBODIMENTS OF THE INVENTION

Figure 1:
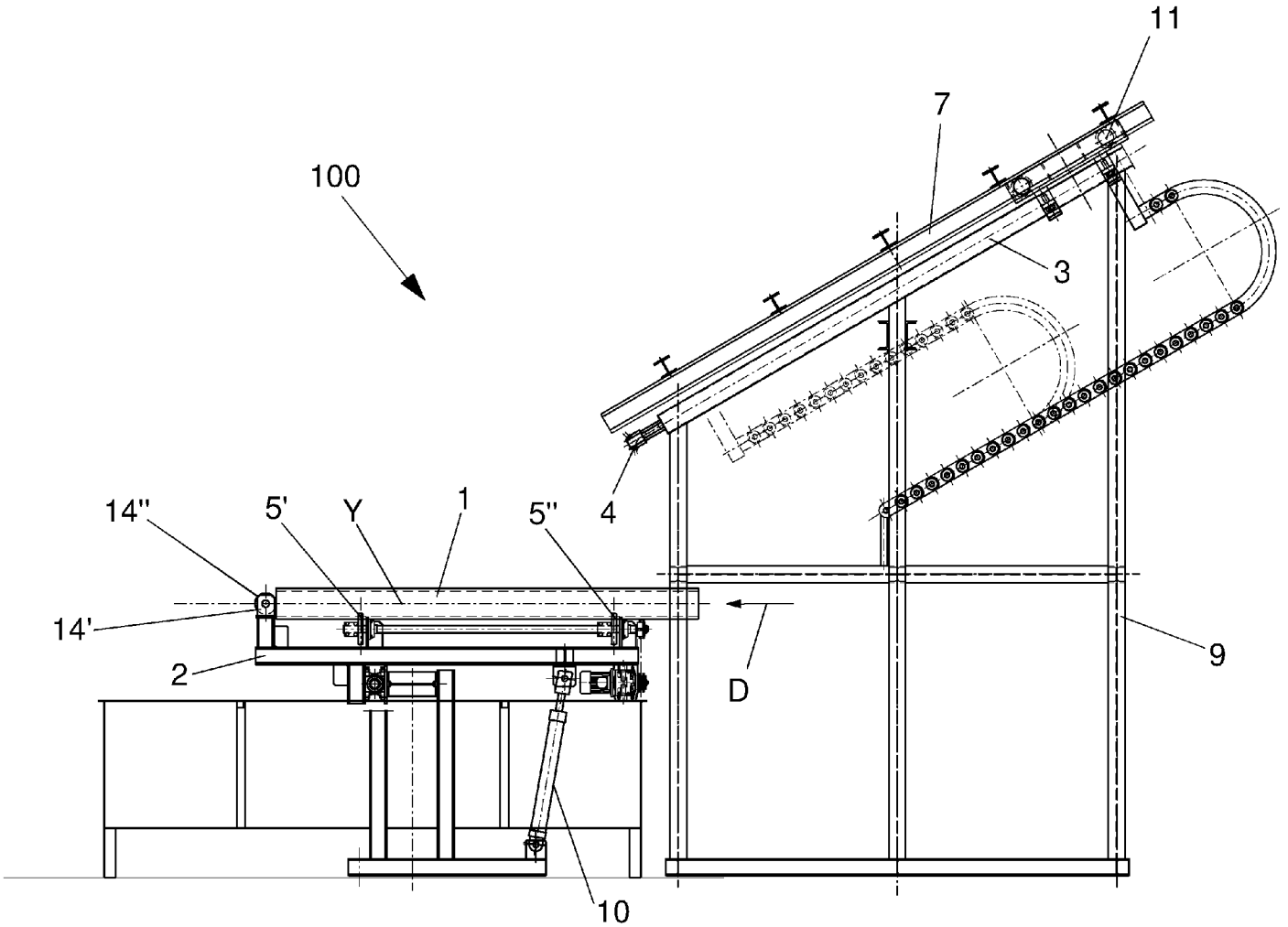
FIG. 1 is a side view of the descaling device of the invention.

With particular reference to the figures, a device for descaling the inner surfaces of tubes, indicated by reference numeral 100 as a whole, is arranged along a tube production line, in particular at the inlet of the rolling train, but not exclusively in such a position as the device is adapted to be positioned where the descaling operation needs to be performed.

Figure 2:
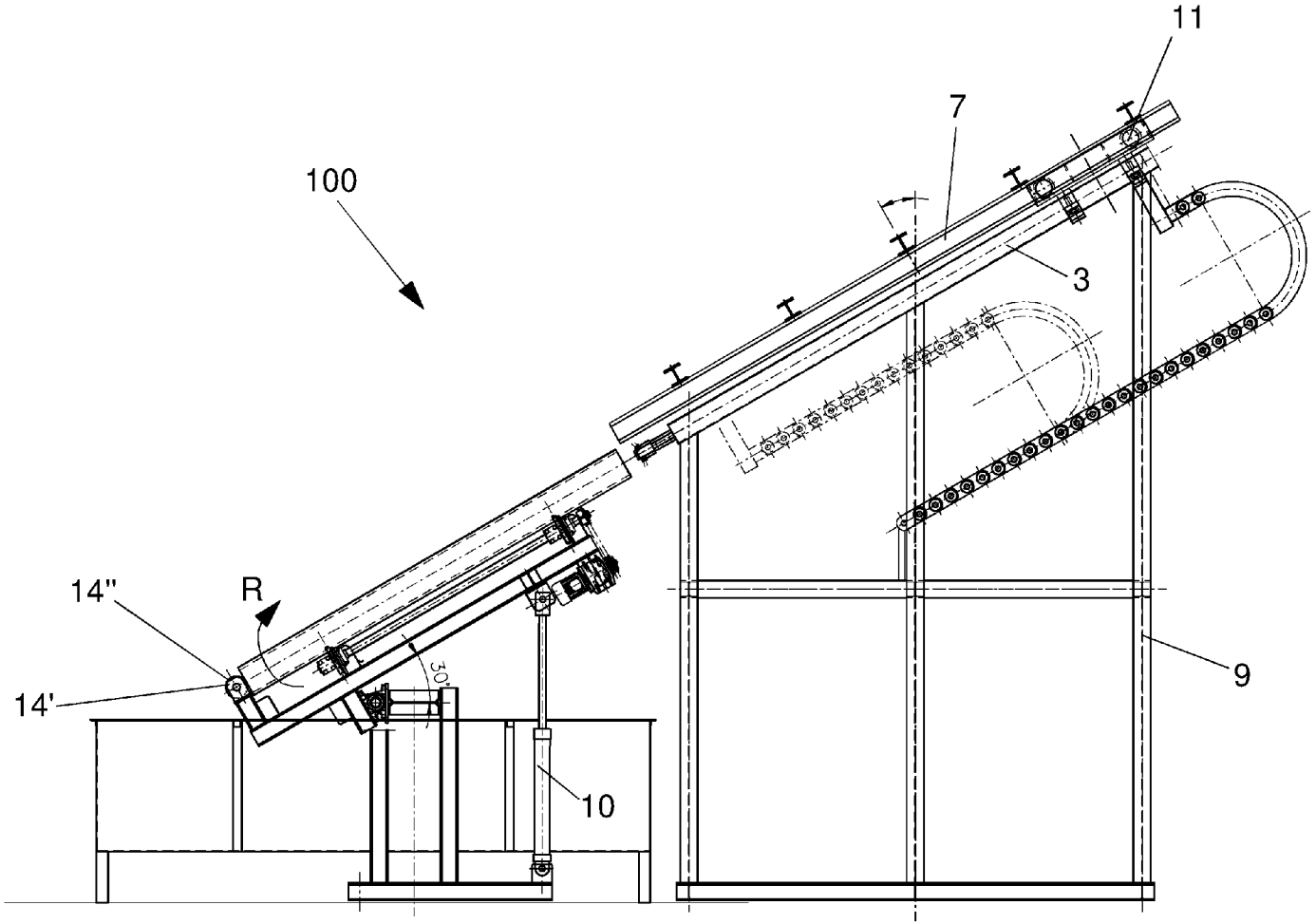
FIG. 2 is a side view of the descaling device of the invention in an operative position different from that shown in FIG. 1.
Figure 3:
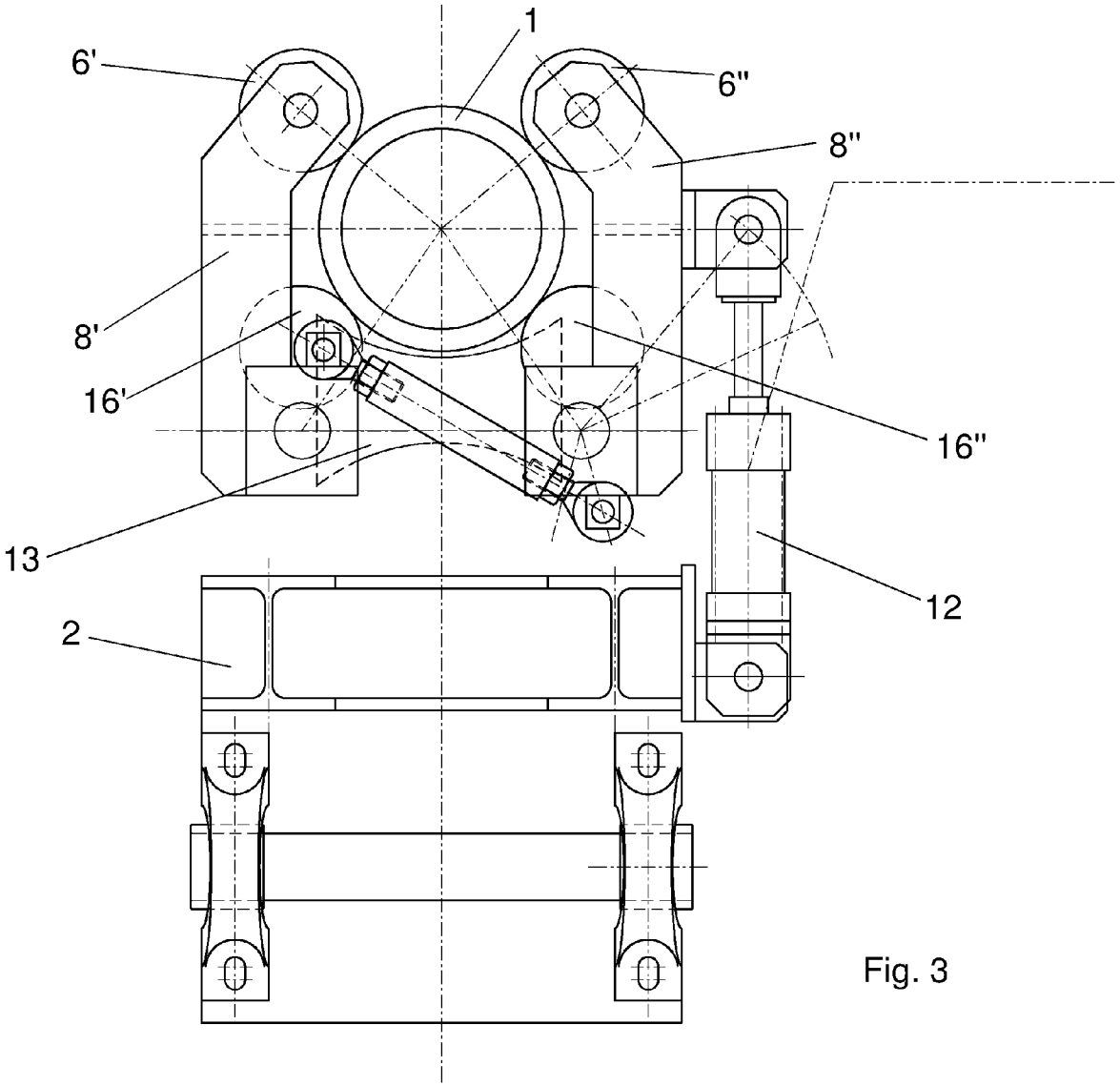
FIG. 3 is a section view taken along a plane transversal to the longitudinal axis of the tube of the descaling device in FIG. 1, showing a detail of the device in a first operative position.

The descaling device 100 comprises a conveyor 2, only partially shown, which conveys the tube 1 during the casting and/or rolling operations along a direction Y, e.g. in the direction of arrow D. It also comprises a supporting base 9 which supports a guiding structure 7, arranged above the rolling line Y, thus not interfering with the rest of the plant, on which a lance 3 provided with a water spraying nozzle 4 hangs. Conveyor 2, in the stretch shown in FIGS. 1, 2, 3, is inclinable with an end which is arranged upwards thus revolving it in the direction of arrow R to arrange the tube 1 in the inclined position with respect to the horizontal plane with an upward-facing end. In the figure, it is the tail part of tube 1 which is lifted. The inclination is advantageously achieved, by means of actuating means 10 of the hydraulic or electric type, or by means of other lifting means of equivalent type.

Alternatively, the stretch of conveyor 2 may be also inclined at the descaling device, by lowering an end of tube 1 or by revolving an intermediate point of the tube 1.

Lance 3 is fixed onto a carriage 11 sliding on the guiding structure 7 and is actuated, for example, by means of a rack-and-pinion type control, which controls the axial translation thereof along the guiding structure 7 and can run over the entire length of the tube 1 so as to descale its whole inner surface.

In a variant of the invention, the nozzle 4 may advantageously consist of a set of revolving sprays.

Advantageously, the lance 3 may also include, in addition to the descaling water jets, one or more jets of pressurized air to clean the interior of the tube 1 from the previously sprayed water.

During the machining process, the tube 1 conveyed along conveyor 2 reaches the location in which the descaling device 100 is arranged at the stretch of conveyor 2 which is inclinable upwards, which allows to revolve the tube while aligning it with the axis of lance 3.

The inclination of the stretch of conveyor 2, and the consequent positioning of lance 3 inclined at an acute angle with respect to the horizontal plane, may be carried out either in the conveying direction indicated by arrow D or in the opposite direction.

According to the length of tube 1, it may be inclined by an angle from 10° to 90°, preferably from 10° to 45°, particularly advantageous is the selection of an angle of 30°, corresponding to the position shown in FIG. 2.

Once the tube 1 has been positioned at the proper angle or already during the lifting operation, it is revolved about its axis by motorized drive rollers 5', 5" arranged only underneath the tube 1 in the inclinable stretch of conveyor 2.

Figure 4:
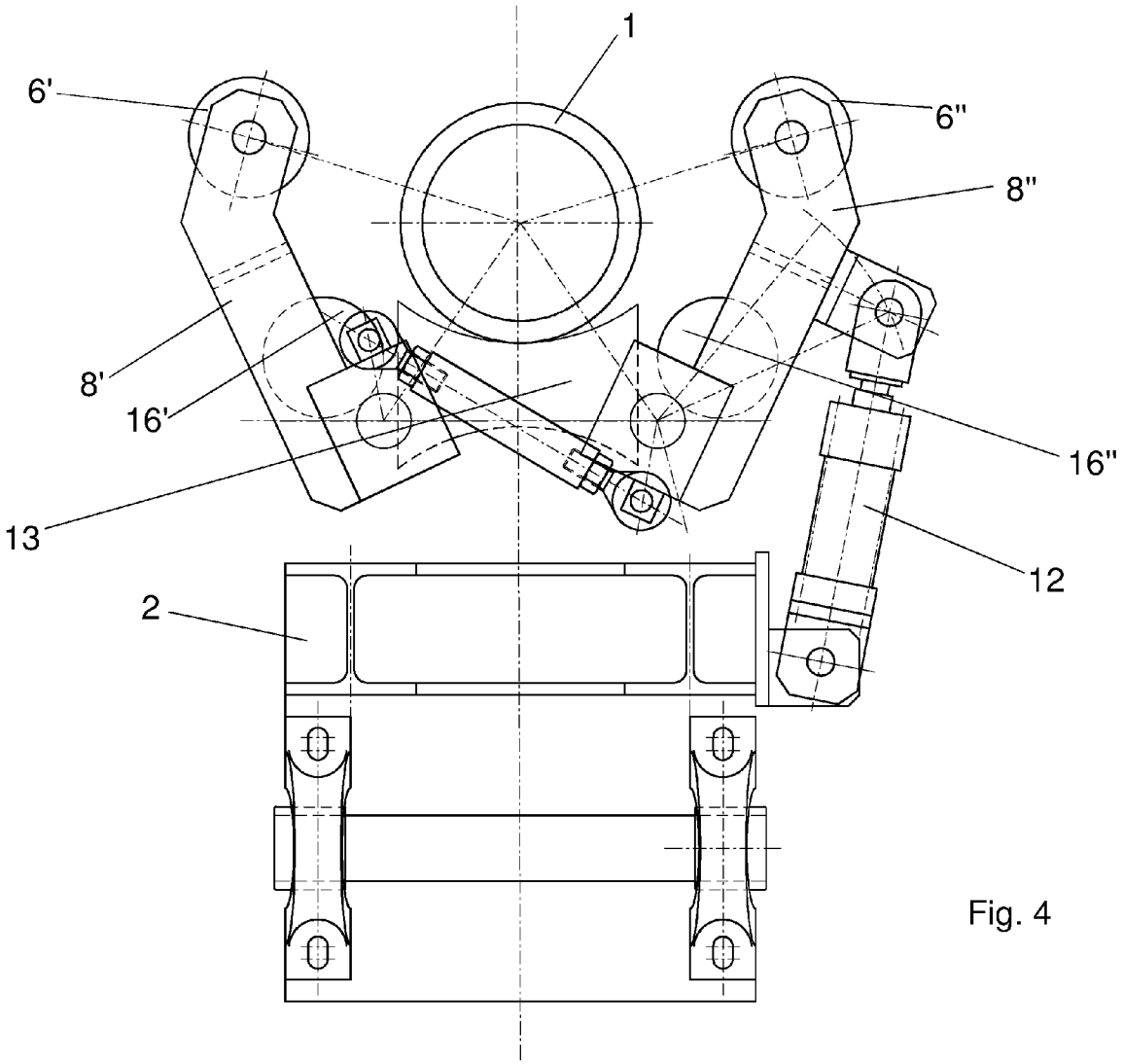
FIG. 4 is a section view taken along a plane transversal to the longitudinal axis of the tube of the descaling device of FIG. 1, showing a detail of the device in a different operative position as compared to the previous one.

In an advantageous variant of the descaling device, shown in FIGS. 3 and 4, idle rollers 6', 6", are also included in addition to the motorized rollers 16' and 16", arranged on the arms 8', 8", above and below the tube 1, respectively, so as to keep it in the longitudinal position, while allowing however its revolution about the axis thereof. The closing and opening of the rollers 6', 6", 16' and 16" is controlled by a jack 12. In FIG. 4, the rollers 6', 6", 16' and 16" are in an open position, as they are not in contact with the tube, which rests instead on the shaped rollers 13 of conveyor 2. In FIG. 3, the rollers 6', 6", 16' and 16" are shown in the closed position: the motorized rollers 16' and 16" lift the tube so that it loses contact with the shaped rollers 13 of conveyor 2 thus being free to revolve about its axis without scraping on the shaped rollers 13, while the rollers 6' and 6" keep tube 1 in the contact position against the motorized rollers 16' and 16", thus ensuring an accurate revolution.

In order to prevent the tube from slipping downwards when inclined, an axial stopping system is provided, which comprises two rollers 14', 14" positioned with the axis perpendicular to the rolling direction, which define the stop and positioning point of the tube in the axial direction while allowing its revolution about the axis thereof. Said rollers 14', 14" are advantageously positioned on an axis perpendicular to the tube axis. Alternatively, the rollers 14', 14" may be replaced with low-friction coefficient abutment surfaces.

The revolution of tube 1 about its longitudinal axis allows to obtain uniformity in the descaling process. By virtue of the revolution of tube 1, the cooling is uniformly distributed along the inner surface of tube 1.

Once the tube 1 has been positioned with the proper inclination for descaling, it is revolved about its axis and the lance 3 is introduced therein, at the end of which the nozzle 4 spraying pressurized water is arranged.

The position shown in FIG. 2 refers to an optimal inclination of 30° of the tube 1 with respect to the horizontal plane. This inclination allows an easy outflow of water and scale from the tube.

When the nozzle 4 reaches the opposite end of tube 1, it stops the outflow of pressurized water and, starting the backwards exiting stroke from the tube 1, it may advantageously spray lubricant, either with or without antioxidant properties, such as for example borax, on the inner surface of the tube 1.

In an alternative variant, the lance 3 may be retracted and inserted again into the tube in a second step to deposit the antioxidant lubricant from the top downwards. In this case the lubricant which does not adhere to the wall and slides along the tube 1, possibly even with the aid of the air jet for cleaning the tube, is finally advantageously collected in a container dedicated for this purpose.

When the nozzle 4 is completely retracted and no longer within tube 1, the revolution of the latter about its axis is stopped and the tube 1 is returned to the horizontal axis where it proceeds along the production line, e.g. resuming the motion in the direction of arrow D.

The descaling process according to the invention and implemented by means of the above-described device comprises the following steps:

a. the tube 1 is conveyed along conveyor 2, and when it reaches the descaling device 100 it is centered and inclined by an angle, with respect to the horizontal plane, from 10° to 90°, preferably from 10° to 45°, b. the tube 1 is revolved about its longitudinal axis, by means of the drive roller device 5', 5" (or 6', 6", 16' and 16"), c. the lance 3, integral with the nozzles 4, is introduced into the tube 1 and the high-pressure water jets are actuated to remove the scale from the inner surface, d. in the return stroke of the nozzle 4, or in an appropriately provided next stroke, lubricant and/or antioxidant material (e.g. borax) is possibly sprayed on the inner surface of the tube, e. after the lance 3 has been completely extracted from the interior of the tube 1, the tube 1 is repositioned on the horizontal axis by lowering the inclinable conveyor stretch, f. the tube 1 is conveyed towards a subsequent working position along conveyor 2.

The following advantages can be obtained by virtue of the above-described device and process of the invention:

- the descaling method is adapted to be used on tubes from a continuous casting station or from a heating furnace,
- the operation of descaling the inner surface of the tubes is carried out with less cooling of the tubes because water and scale are quickly evacuated due to the inclination of the tubes,
- the solution allows to contain the length of the descaling area, and thus the length of the production line,
- the descaling step is carried out on the rolling line, and this allows the production times to be reduced,
- the inner surface of the tube may be coated with an antioxidant material in the same descaling cycle, with reduction of temperature loss of the tubes.

The invention claimed is:

1. A descaling device for descaling an inner surface of a tube comprising a supporting structure, a conveyor for conveying the tube in a direction parallel to a longitudinal axis of the tube, a lance for spraying a fluid inside the tube to perform an operation of descaling the inner surface, actuating means for actuating the lance in order to translate the lance in an axial direction inside the tube during a descaling operation, wherein a portion of the conveyor is inclinable to be arranged in a predetermined inclined position with respect to a horizontal plane, and said lance is fixed to sliding guiding means above the conveyor in the predetermined inclined position.

2. A descaling process implemented by means of the device of claim 1, comprising the following steps:

a) conveying the tube, by means of the conveyor, to the descaling device and inclining said tube with respect to the horizontal plane by a predetermined angle, b) revolving the tube about its longitudinal axis, c) introducing the lance into the tube and actuating water jets on the inner surface of the tube, d) extracting the lance from the interior of the tube during a return stroke, e) positioning the tube on the horizontal axis by lowering the inclinable conveyor portion.

3. A process according to claim 2, wherein lubricant and/or antioxidant material is sprayed onto the inner surface of the tube during the return stroke or during a next stroke.

4. A device according to claim 1, wherein there are provided revolving means for revolving the tube about its axis when it is in an inclined position.

5. A device according to claim 4, wherein the revolving means for revolving the tube comprise drive rollers.

6. A device according to claim 5, wherein the lance has spraying means for spraying a lubricant and/or antioxidant substance inside the tube.

7. A device according to claim 6, wherein idle rollers are provided for holding the tube when it revolves about its axis against drive rollers.

8. A device according to claim 7, wherein stopping rollers are provided for holding the tube in a predetermined axial position on the conveyor portion when the conveyer portion is in an inclined position.

* * * * *